US006695869B2

(12) United States Patent
Fitzpatrick et al.

(10) Patent No.: US 6,695,869 B2
(45) **Date of Patent: *Feb. 24, 2004**

(54) PACIFIER

(75) Inventors: William E Fitzpatrick, Wyckoff, NJ (US); Aiden J Petrie, Providence, RI (US); Richard D La Torre, Oakland, NJ (US)

(73) Assignee: Playtex Products, Inc., Westport, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/997,318

(22) Filed: Nov. 28, 2001

(65) Prior Publication Data

US 2003/0100922 A1 May 29, 2003

(51) Int. Cl.[7] ..... A61J 17/00
(52) U.S. Cl. ..... 606/234; 606/236
(58) Field of Search ..... 606/234; 128/360; D24/194

(56) References Cited

U.S. PATENT DOCUMENTS

| | | | | |
|---|---|---|---|---|
| 3,825,014 A | | 7/1974 | Wroten | 128/360 |
| 3,886,949 A | | 6/1975 | Hurst et al. | 128/360 |
| 4,143,452 A | | 3/1979 | Hakim | 29/434 |
| D267,116 S | | 11/1982 | Bubelis | D24/46 |
| 4,545,378 A | | 10/1985 | Chrones | 128/360 |
| D334,064 S | | 3/1993 | Fitzpatrick | D24/194 |
| 5,275,619 A | * | 1/1994 | Engebretson et al. | 606/236 |
| 5,403,349 A | | 4/1995 | Röhrig | 606/234 |
| 5,476,881 A | | 12/1995 | Suh | 523/122 |
| D380,836 S | | 7/1997 | Fitzpatrick et al. | D24/194 |
| 5,653,731 A | | 8/1997 | Röhrig | 606/234 |
| 5,688,238 A | * | 11/1997 | Moser et al. | 604/77 |
| 5,759,195 A | * | 6/1998 | Fields et al. | 606/236 |
| D404,137 S | | 1/1999 | Underwood et al. | D24/194 |
| 5,868,131 A | * | 2/1999 | Murchie | 128/204.13 |
| D409,309 S | | 5/1999 | Tollman | D24/194 |
| D413,387 S | | 8/1999 | Fitzpatrick et al. | D24/194 |
| 6,032,810 A | | 3/2000 | Meyers et al. | 215/11.1 |
| 6,241,110 B1 | * | 6/2001 | Hakim | 215/11.1 |

FOREIGN PATENT DOCUMENTS

| | | | | |
|---|---|---|---|---|
| DE | 3316824 A1 | * | 11/1984 | A61J/11/00 |
| DE | 3347876 A1 | | 5/1985 | |
| EP | 0381076 | | 8/1990 | |
| WO | WO 94/23686 | | 10/1994 | |

* cited by examiner

*Primary Examiner*—Michael J. Milano
*Assistant Examiner*—Bradford C Pantuck
(74) *Attorney, Agent, or Firm*—Ohlandt, Greeley, Ruggiero & Perle, LLP

(57) ABSTRACT

There is provided a one-piece pacifier that has two substrates in which the second or outer substrate overmolds onto the first or inner substrate. The two substrates for the pacifier form a shield for the pacifier. The outer substrate forms the pacifier's nipple. The pacifier is made by forming a plurality of holes in the inner substrate and overmolding the outer substrate onto the inner substrate to form a nipple and a shield for the pacifier.

18 Claims, 4 Drawing Sheets

PACIFIER

BACKGROUND OF THE INVENTION

1. Field of the Invention

The present invention relates to pacifiers for newborn infants. More particularly, the present invention relates to an integral pacifier having two substrates or layers molded together.

2. Description of the Prior Art

There are many types of infant pacifiers available. Generally, all pacifiers have a nipple on which an infant can suck and/or bite, a mouth shield for preventing the infant from ingesting the pacifier, and a handle to give the infant or supervising adult a convenient structure for gripping and/or holding the pacifier.

Typically, pacifiers are made of multiple components and/or formed as an integral unit. Pacifiers made of multiple components generally have a flexible nipple surrounded by a rigid mouth shield. The nipple of this type of pacifier typically passes through an aperture in the center of the mouth shield, creating a sharp corner, and sometimes a crevice, between the shield and the shaft of the nipple where saliva, dirt and the like can accumulate. It is sometimes difficult to keep this type of pacifier clean. Additionally, certain issues regarding safety may arise with this type of pacifier.

Integrally formed pacifiers are typically made of a plastic selected to provide the nipple with the desired flexibility and the mouth shield and handle with the necessary rigidity. Generally, the selection of plastic is governed by the need to provide a relatively rigid mount shield and handle. The nipple, therefore, is usually more rigid than desired.

SUMMARY OF THE INVENTION

It is an object of the present invention to provide a one-piece pacifier comprising an interior or inner substrate and an outer substrate, in which the outer substrate is overmolded onto the inner substrate to form a shield.

It is another object of the present invention to provide such a one-piece pacifier, in which the outer substrate that is overmolded onto the inner substrate forms a nipple with a hollow interior.

These and other objects and advantages of the present invention are achieved by overmolding an outer substrate onto an inner substrate to form a shield and a nipple for the pacifier.

DESCRIPTION OF THE INVENTION

Figure 1:
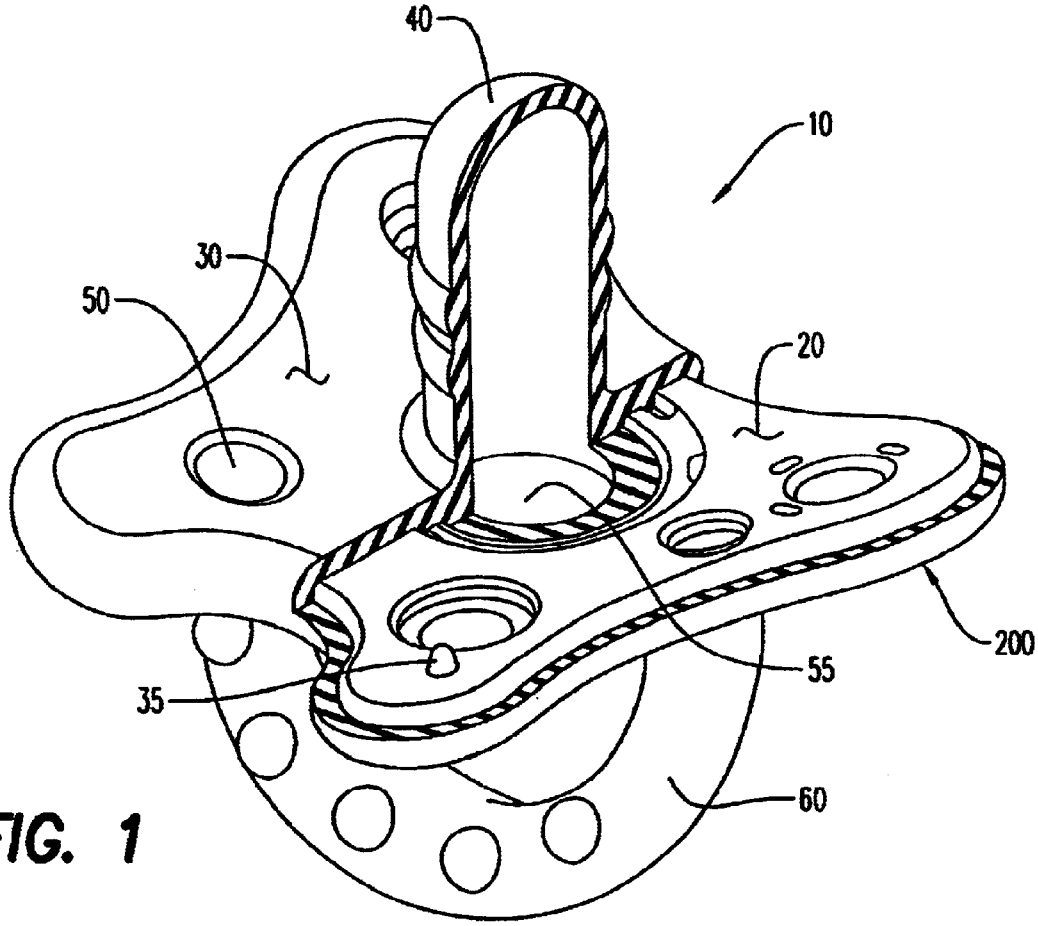
FIG. 1 is a perspective view, partially cutaway, of the one-piece pacifier of the present invention.
Figure 2:
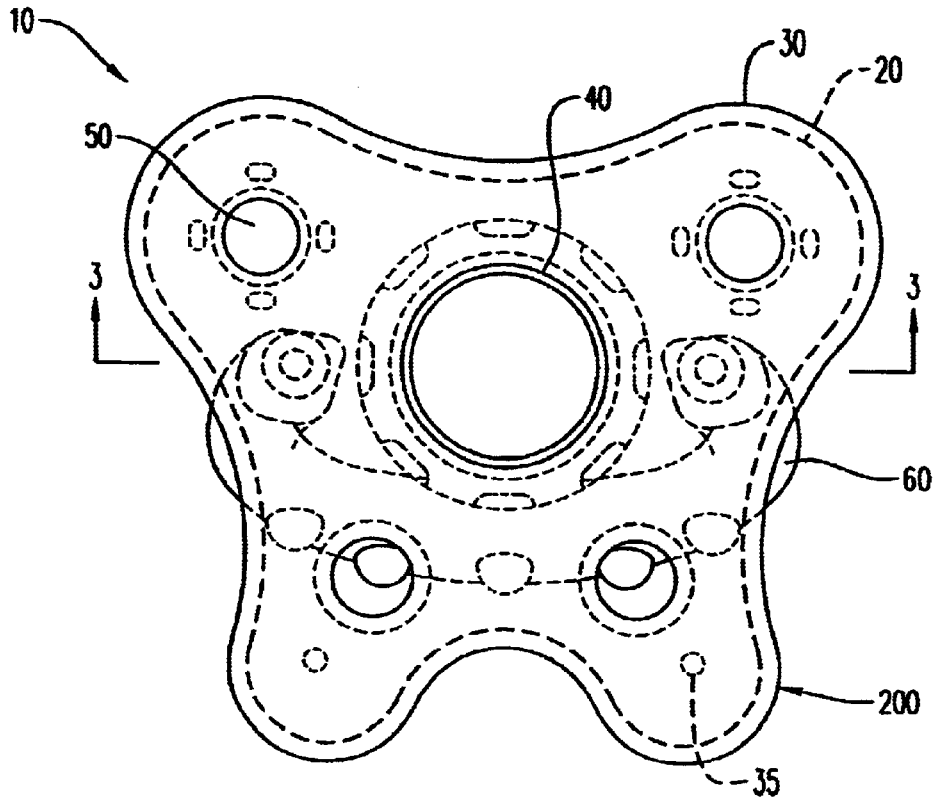
FIG. 2 is a top view of a full pacifier of FIG. 1.
Figure 3:
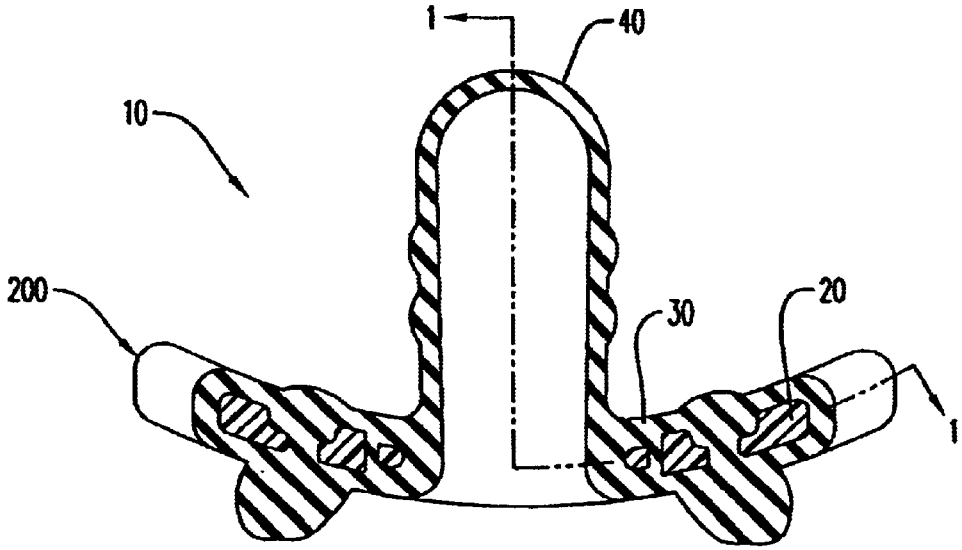
FIG. 3 is a cross-sectional view taken along line 3—3 of FIG. 2.
Figure 4:
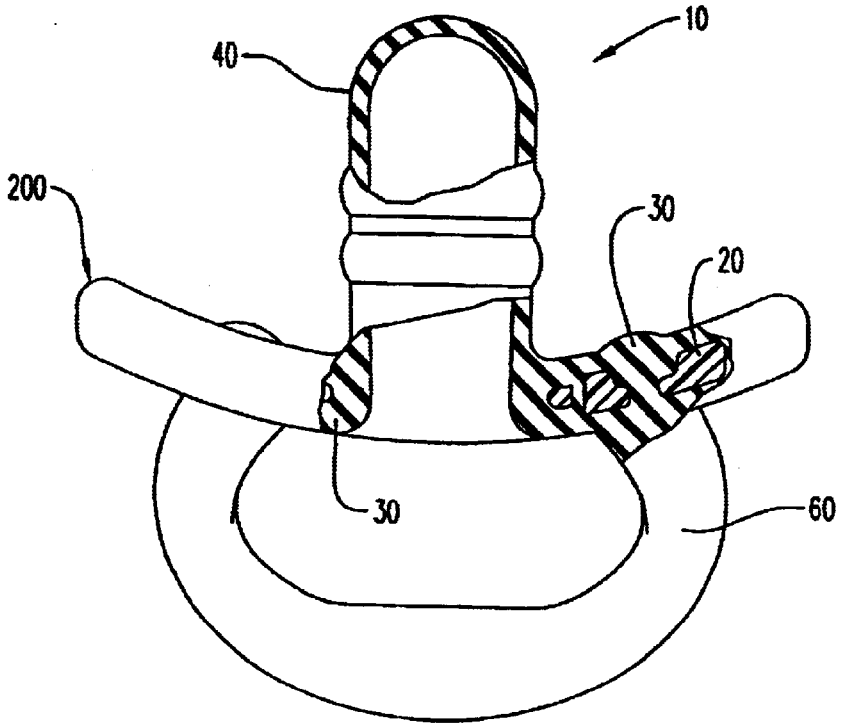
FIG. 4 is a view of FIG. 1.
Figure 5:
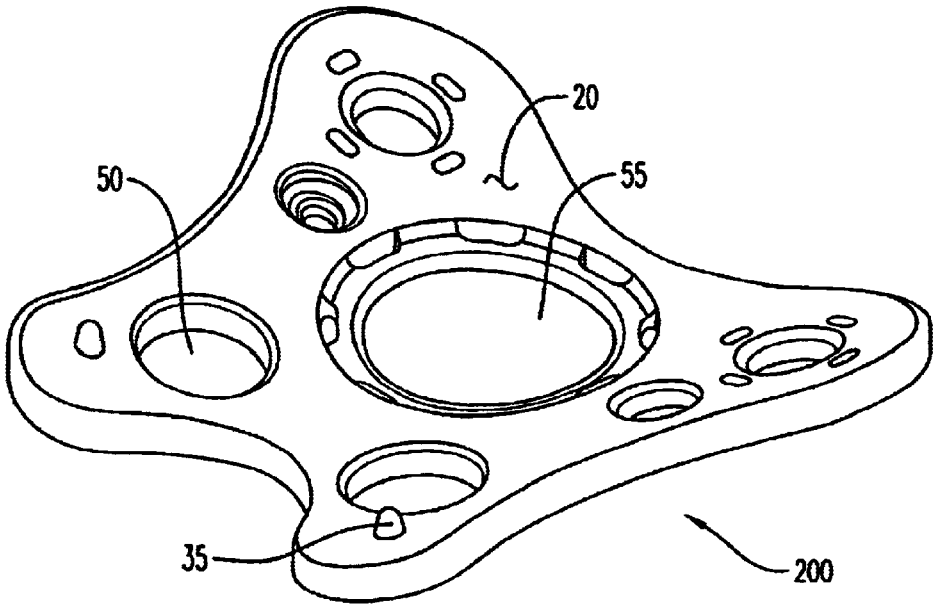
FIG. 5 is a perspective view of the shield of the pacifier of FIG. 1.
Figure 6:
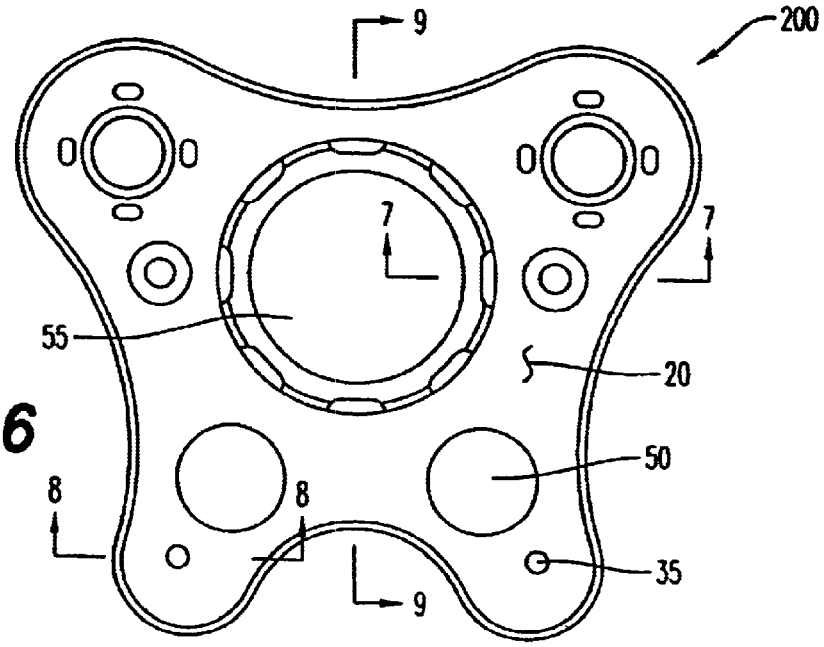
FIG. 6 is a bottom view of the shield of FIG. 1.
Figure 7:
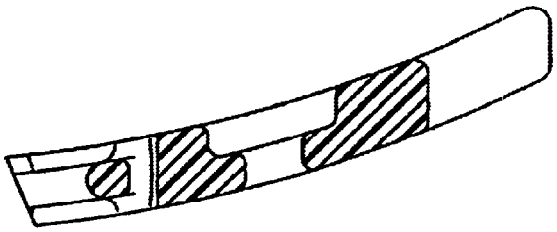
FIG. 7 is a cross-sectional view taken along line 7—7 of FIG. 6.
Figure 8:
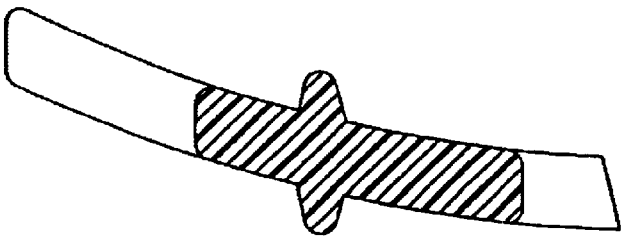
FIG. 8 is a cross-sectional view taken along line 8—8 of FIG. 6.
Figure 9:
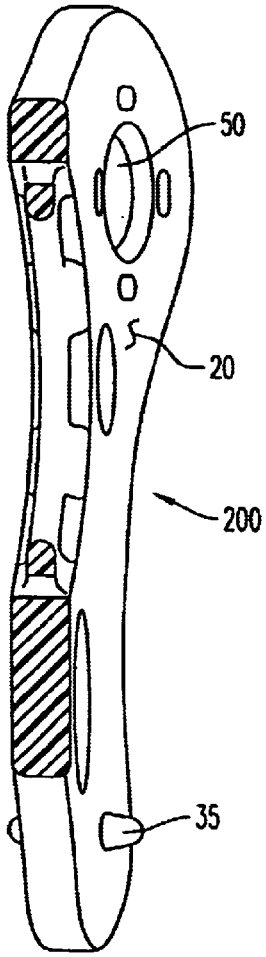
FIG. 9 is a cross-sectional view taken along line 9—9 of FIG. 6.

Referring to the drawings and, in particular, FIG. 1, there is shown a pacifier generally represented by reference numeral 10. Pacifier 10 has a nipple 40 and a shield 200. Pacifier 10 preferably also has a gripping handle 60.

Pacifier 10 including nipple 40 and shield 200 is formed with an inner or interior substrate or material 20 and an outer substrate or material 30 that is overmolded to the inner substrate. In a preferred embodiment shown in FIG. 1, nipple 40 is entirely formed by the overmolded outer material 30. In this embodiment, nipple 40 is preferably hollow.

The inner substrate 20 that forms the basis for shield 200 has a relatively central hole 55, and preferably at least one, and more preferably, two or more, additional holes or grooves 50. Some of holes 50 are covered by the overmolded outer material 30.

In the preferred embodiment shown in FIG. 1, shield 200 includes a portion of inner substrate 20 and outer material 30, while nipple 40 of the present invention is entirely formed by the overmolding process and has a hollow interior.

As stated before, inner substrate 20 includes central or center hole 55 and at least one additional hole 50. Preferably, inner substrate 20 has a plurality of additional holes 50. Holes 50 are of different sizes and are positioned throughout inner substrate 20, except at center hole 55. Some of holes 50 are covered by outer material 30 during overmolding so that these holes appear to be closed. These holes or grooves facilitate securing outer material 30 onto inner substrate 20. Other of holes 50 are covered by outer material 30 during overmolding, yet they remain as holes. Also, preferably there are one or more embossments 35 on inner substrate 20. Some embossments 35 remain after outer substrate 30 is applied to inner substrate 20. The embossments 35 are protected since the overmolding protects the inner structure, therefore offering a coat of protection to the infant using the pacifier, yet providing a gripping or play surface to the infant. Also, the embossments 35 are proturbances that aid in securing the outer substrate 30 to the inner substrate 20 in the overmolding process.

The inner substrate 20 is preferably made of a rigid material or is rigid. The inner substrate 20 can be made of nylon, polycarbonate or other suitable thermoplastic material. Preferably, inner substrate 20 is made of nylon. The outer substrate 30 is made of silicone, thermoplastic elastomer (TPE) or other suitable elastomeric material. Preferably, outer substrate 30 is made of silicone. The outer substrate 30 is preferably made of an elastomeric material or is elastomeric.

By integrally forming the present pacifier nipple 40 as part of the shield 200, the possibility of pacifier 10 breakage is diminished. The integral structure requires disintegration of the entire structure for breakage to result. This is an important safety consideration. The present one-piece structure results in a safer pacifier.

The one-piece pacifier 10 of the present invention will be less costly to manufacture as there is no additional manipulative step of securing nipple 40 to the shield 200 in its manufacture.

The present invention's overmold design permits for an enhanced decorative appearance. Additionally, it also facilitates the development of a decorative appearance. It allows for a decorative design to be placed on the inner substrate, which is then covered or protected by the clear overmolded coating. Thus, the clear coating covers and protects the decorative design from being rubbed off by the child. Possible decorative designs that may be utilized include various colors, images of animals or other characters, or a brand name.

The present invention having been thus been described with particular reference to the preferred forms thereof, it will be obvious that various changes and modifications may be made therein without departing from the spirit and scope of the present invention as defined in the appended claims.

What is claimed is:

1. A pacifier comprising:

a first substrate having a primary hole and a plurality of secondary holes; and a second substrate that overmolds onto said first substrate, wherein said first and second substrates form a shield for said pacifier, and wherein said second substrate covers only some of said plurality of secondary holes and alone forms a nipple for said pacifier.

2. The pacifier of claim 1, wherein said first substrate is made from a rigid material.

3. The pacifier of claim 2, wherein said material is selected from the group consisting essentially of nylon, polycarbonate, and any combination thereof.

4. The pacifier of claim 1, wherein said second substrate is made from an elastomeric material.

5. The pacifier of claim 4, wherein said material is selected from the group consisting essentially of silicone, TPE, and any combination thereof.

6. The pacifier of claim 1, wherein said first substrate includes an embossment to aid in securing said second substrate to said first substrate.

7. The pacifier of claim 1, wherein said nipple has a hollow interior.

8. A one-piece pacifier comprising:

a rigid material substrate having a primary hole and a plurality of secondary holes; and an elastomeric material coating that is overmolded onto said rigid material substrate, wherein said rigid material substrate and elastomeric material coating form a shield, and wherein said elastomeric material coating covers only some of said plurality of secondary holes and alone forms a hollow nipple.

9. The pacifier of claim 8, wherein said elastomeric material is selected from the group consisting essentially of silicone, TPE, and any combination thereof.

10. The pacifier of claim 8, wherein said elastomeric material is a silicone.

11. The pacifier of claim 8, wherein said rigid material is selected from the group consisting essentially of nylon, polycarbonate, and any combination thereof.

12. The pacifier of claim 8, wherein said rigid material is a nylon.

13. The pacifier of claim 8, wherein said shield has a gripping handle.

14. A method of making a pacifier comprising:

forming a primary hole and a plurality of secondary holes in an inner substrate; and overmolding an outer material onto said inner substrate to cover only some of said plurality of secondary holes to form a nipple and a shield for the pacifier.

15. The method of claim 14, wherein said inner substrate is made from a rigid material.

16. The method of claim 15, wherein said rigid material is selected from the group consisting essentially of nylon, polycarbonate, and any combination thereof.

17. The method of claim 14, wherein said outer material is made from an elastomeric material.

18. The method of claim 17, wherein said elastomeric material is selected from the group consisting essentially of silicone, TPE, and any combination thereof.

* * * * *